US005809364A

United States Patent [19]

Tombs et al.

[11] Patent Number: 5,809,364

[45] Date of Patent: Sep. 15, 1998

[54] INSTABILITY DETECTION FOR CORONA CHARGERS

[75] Inventors: Thomas N. Tombs, Brockport; John W. May, Rochester, both of N.Y.

[73] Assignee: Eastman Kodak Company, Rochester, N.Y.

[21] Appl. No.: 858,319

[22] Filed: May 19, 1997

[51] Int. Cl.[6] ..... G03G 15/00; G03G 15/02

[52] U.S. Cl. ..... 399/9; 361/230; 399/170

[58] Field of Search ..... 399/50, 9, 170; 250/324, 325, 326; 361/225, 230

[56] References Cited

U.S. PATENT DOCUMENTS

| | | | |
|---|---|---|---|
| 4,105,321 | 8/1978 | Urso | 399/50 |
| 4,188,530 | 2/1980 | Miller | 250/324 |
| 4,248,519 | 2/1981 | Urso | 399/50 |
| 4,583,836 | 4/1986 | Taniguchi et al. | 399/170 X |
| 4,731,633 | 3/1988 | Foley et al. . | |
| 5,028,779 | 7/1991 | Gundlach et al. | 250/325 |
| 5,083,145 | 1/1992 | Gundlach et al. | 250/325 X |
| 5,185,684 | 2/1993 | Beihoff et al. . | |
| 5,185,685 | 2/1993 | Tennies et al. . | |
| 5,185,687 | 2/1993 | Beihoff et al. . | |
| 5,208,542 | 5/1993 | Tennies et al. . | |
| 5,223,795 | 6/1993 | Blades . | |
| 5,432,455 | 7/1995 | Blades . | |
| 5,434,509 | 7/1995 | Blades . | |
| 5,452,223 | 9/1995 | Zuercher et al. . | |

OTHER PUBLICATIONS

R. Feng, G. S. P. Castle, and S. Jayaram; "Automated System for Power Measurement in the Silent Discharge"; Conf. Record of the 1996 IEEE Industry Appl. Society; vol. 4, pp. 2076–2082, Fig. 2.

*Primary Examiner*—S. Lee
*Attorney, Agent, or Firm*—Norman Rushefsky

[57] ABSTRACT

A corona charger in an electrostatographic reproduction apparatus includes a coronode and a power supply applying a voltage to the coronode. A detector detects pre-arc noise in the operation of the coronode and issues a signal that is used to adjust operation of the power supply to avoid arcing and/or to indicate a malfunction condition.

19 Claims, 13 Drawing Sheets

INSTABILITY DETECTION FOR CORONA CHARGERS

CROSS REFERENCE TO RELATED APPLICATIONS

This application is related to U.S. application Ser. No. 08/858,752 filed on even date herewith in the names of May et al and entitled "Corona Charging of a Charge Retentive Surface."

BACKGROUND OF THE INVENTION

1. Field of the Invention

This invention relates to corona charging and more particularly to methods and apparatus for corona charging a charge retentive surface and is particularly suited for use in electrostatographic recording apparatus.

2. Description Relative to the Prior Art

A problem encountered in corona wire charging as a charger ages is an increasing risk of arcing associated with the charger, especially when using a gridded charger. Typical types of arcing are: wire to grid, wire to shell, and grid to film. Arcing can be induced by contamination buildup of silica dendrites on corona wires, or by dust particles or fibers carried to a charger from other parts of a copier and deposited on corona wires, grid or shell.

Arcing problems involving a charger's wire, shell, or grid are generally more serious with AC than with DC chargers. With AC charging, there is a significant probability that arcing can also involve the high voltage cables or connectors.

As a charger ages in an electrophotographic machine, the first indications of a potential arcing problem are pre-arcing transient current pulse phenomena having high frequency components. Pre-breakdown transient pulse phenomena can adversely affect image quality by producing unwanted streak defects or point defects in prints. Such defects warrant early replacement of chargers by a service engineer. (Image defects can also be caused by arcing or pre-arcing events occurring in high voltage AC cabling or connectors.) At some later age of the charger, any occurrence of actual arcing is very objectionable to a customer and usually causes a hard shutdown of an electrophotographic copier or printer. This will involve a costly unscheduled service call, and replacement of the offending charger (or cabling, or connectors).

Objectionable transient current pulses can occur, for example, in positive DC charging, resulting in a copy quality defect known as "sheeting" or "pepper tracking" [hereafter referred to as sheeting]. Sheeting is found primarily at low relative humidity (RH) and it can be serious for tungsten corona wires, especially aged wires that have been used for a long time in a copier. Less serious sheeting is found using platinum alloy wires, e.g., such as used in a commercial KODAK 1575 Copier Duplicator manufactured by Eastman Kodak Company. Small, localized areas on the corona wires, or "hot spots", can emit bursts of positive ions in self-limiting streamers or pulses which are of the order of 100 nanoseconds to microseconds in duration. Strong sheeting can sometimes produce visible streamers that can be observed in the dark as radial discharges connecting glowing hot spots on the wire to the charger shell or grid. Repetitive pulses, at intervals typically in the range 2 to 20 milliseconds from a given "hot spot", can produce chains of small areas of excess positive charge on a moving photoconductor in a copier. These pulse trains are somewhat irregular in time, and start and stop rather randomly as "hot spots" move about to new sites on the wire. Groups of "hot spots" can produce bands of highly charged circular spots on a moving photoconductor. The local charge density in these spots far exceeds the surrounding average charge density on a photoconductor as it leaves the charging station in an electrophotographic machine. When the photoconductor has been exposed to light, the highly charged micro-areas on the surface of the photoconductor, caused by sheeting, are barely discharged compared to the surrounding areas. After the resulting charge pattern has been toned by the technique of discharged area development, and the toner transferred to paper, sheeting defects in a resulting print appear as small circular white spots, each having a surrounding dark ring of excess toner. These spots typically have diameters in the approximate range 0.1 to 1 mm. If the technique of charged area development is used instead to develop the charge pattern, dark circular spots, each having a light surrounding ring, are produced in prints. Sheeting defects are objectionable in positive DC charging, especially for high quality electrophotographic applications, and there is a need to prevent or limit their occurrence.

It will be evident from the above discussion that there is a need to diagnose, preferably in real time, the onset of both transient current pulse phenomena and pre-breakdown current pulse instabilities for both AC and DC corona charging. For AC charging, there is an additional need to be able to diagnose instabilities of charging current associated with the onset of pre-breakdown discharges in high voltage cabling and connectors. By providing such diagnoses, it will be possible to replace chargers in the field in timely fashion, i.e., before copy quality has been compromised, perhaps even before objectionable image defects in prints can be discerned by a customer. Moreover, these diagnoses can be used with microprocessors, for example, to drive process control for temporary alleviation of charging current instabilities until the time of charger replacement.

Although the frequency of emission of positive current spikes that give rise to sheeting artifacts is typically in the range 50–500 Hz, the frequency spectrum associated with these instabilities contains much higher frequency components (exceeding 40 Khz in Example 1, FIG. 3 below). In a silent discharge, the frequency spectrum of microdischarge pulses can extend well into the megahertz regime (R. Feng, G. S. P. Castle and S. Jayaram, Conference Record of the 1996 IEEE Industry Applications Society, Vol. 4, 2076–2082, FIG. 2).

As is well known, AC charging typically uses a corona wire charger in which a high voltage AC signal is applied to the corona wires to produce corona emission. This signal usually has an AC voltage component superimposed on a DC offset voltage. The time durations of the positive and negative excursions of the AC component of the waveform are equal, a condition defined here as 50% duty cycle. Prior art using wire chargers has disclosed AC charging using higher duty cycles. For negative charging using an ideal square wave waveform (hypothetical), a negative duty cycle of 80% would require an AC signal in which the negative excursion is four times longer than the positive excursion. For positive charging, a positive duty cycle of 80% would give an AC signal in which the positive excursion is four times longer than the negative excursion. A duty cycle of 100% for either polarity is equivalent to DC charging. May and Pernesky, in the referenced related application, describe how a high positive duty cycle AC gridded charger can reduce the propensity towards sheeting for positive charging under low RH conditions, as compared with conventional DC positive charging using the same device.

SUMMARY OF THE INVENTION

The present invention describes methods of electrically detecting pre-breakdown transient currents, especially as related to avoiding sheeting defects in electrostatographic recording. The invention is also useful in diagnosing pre-breakdown current signals associated with high-voltage connections to corona wires, or in detecting pre-arcing currents between a corona wire and a grid, or between a corona wire and a charger shell.

The invention discloses electrical circuit designs that can be used to monitor and detect the onset of charger problems associated with pre-breakdown transients or actual arcing. In each of these circuits a signal proportional to the current supplied to the corona wire is the input, and the output of each circuit is used for feedback by a process control circuit to limit the amplitude or duration of pre-breakdown electrical noise transients, or is used to trigger an error code or service call. Various well known methods can be used to measure the input and output current signals.

It is possible to use the invention to increase the life of a corona charger by adjusting its operating electrical set points to suppress or limit the amplitude of pre-breakdown transient currents. This can be done with each of the circuit designs disclosed by the invention, using feedback to adjust grid, shield or wire potentials so as to keep the amplitude of the output of the circuit below a threshold or preselected value. In this way, unscheduled replacements of corona wire chargers can be prevented.

BRIEF DESCRIPTION OF THE DRAWINGS

Other aspects of the present invention will become apparent as the following description proceeds with reference to the accompanying drawings in which.

DETAILED DESCRIPTION OF THE PREFERRED EMBODIMENTS OF THE INVENTION

Because corona chargers and electrostatographic reproduction apparatus are well known, the present description will be directed in particular to elements forming part of, or cooperating directly with, the present invention. Apparatus not specifically shown or described herein are selectable from those known in the prior art.

Figure 1:
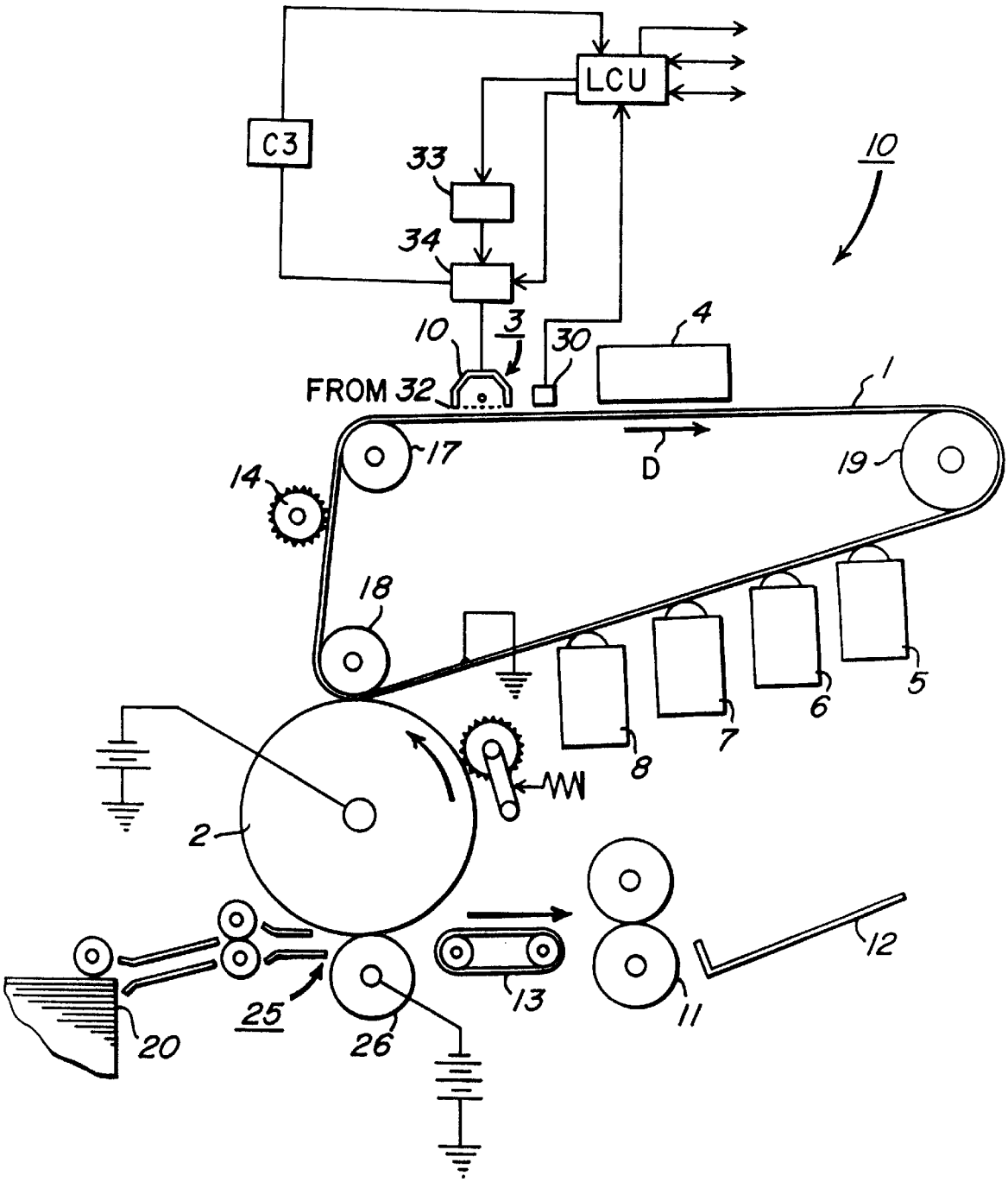
FIG. 1 is a side elevational view in schematic of a color printer apparatus utilizing the invention.

FIG. 1 illustrates one form of electrostatographic apparatus in which the invention is intended to be used. The apparatus 10 includes a primary image member, for example, a photoconductive web 1 trained about rollers 17, 18 and 19, one of which is drivable to move image member 1 in the direction shown by arrow D past a series of stations well known in the electrostatographic art. The primary image member may also be a drum. Primary image member 1 is uniformly charged at a primary charging station 3 with a primary electrostatic charge of positive polarity. Control of the voltage level on the member 1 may be monitored by an electrometer 30 and signals therefrom input to a logic and control unit (LCU) to control operating parameters of the charger as described herein. The LCU may also control the operating parameters of the apparatus or portions thereof. Thereafter the member 1 passes beneath an exposure station 4 and is image wise exposed, e.g., using an LED printhead or laser electronic exposure station or subject to an optical exposure to create an electrostatic image. The image is toned by one of toner stations 5, 6, 7 or 8 to create a toner image corresponding to the color of toner in the station used. The toner image is transferred from primary image member 1 to an intermediate image member, for example, intermediate transfer roller or drum 2 at a transfer station formed between roller 18, primary image member 1 and transfer drum 2. The primary image member 1 is cleaned at a cleaning station 14 and reused to form more toner images of different color utilizing toner stations 5, 6, 7 and 8. One or more additional images are transferred in registration with the first image transferred to drum 2 to create a multicolor toner image on the surface of transfer drum 2. A conductive backing layer coated below the photoconductive layer or layers (not shown) of the primary image member is grounded as shown or biased to a suitable voltage.

The multicolor image is transferred to a receiving sheet which has been fed from supply 20 into transfer relationship with transfer drum 2 at transfer station 25. The receiving sheet is transported from transfer station 25 by a transport mechanism 13 to a fuser 11 where the toner image is fixed by conventional means. The receiving sheet is then conveyed from the fuser 11 to an output tray 12.

The toner image is transferred from the primary image member 1 to the intermediate transfer drum 2 in response to an electric field applied between the core of drum 2 and a conductive electrode forming a part of primary image member 1. The multicolor toner image is transferred to the receiving sheet at transfer station 25 in response to an electric field created between a backing roller 26 and the transfer drum 2.

Alternatively, one or more images may be transferred from the primary image member to a receiver sheet directly as is well known.

Example 1 below describes experimental electronic detection of sheeting currents by oscilloscope, using a gridded single-wire corona charger operated with a high positive duty cycle trapezoidal waveform applied to an aged corona wire. This example demonstrates that sheeting noise from onset of sheeting to imminent arcing can be controlled by adjusting the duty cycle, see cross-referenced May and Pemesky application 08/858,752 that also shows that adjusting the duty cycle of an applied trapezoidal waveform at a fixed value of peak voltage can control sheeting and that adjusting the duty cycle of such waveform at a fixed voltage can also control sheeting. The contents of that application are incorporated herein by reference.

Examples 2–4 describe four major embodiments of the invention. A computer-generated waveform approximately mimics the characteristic high frequency noise waveform associated with pre-breakdown sheeting currents, and is used as the input signal for three different embodiments of the invention.

EXAMPLE 1

Figure 2:
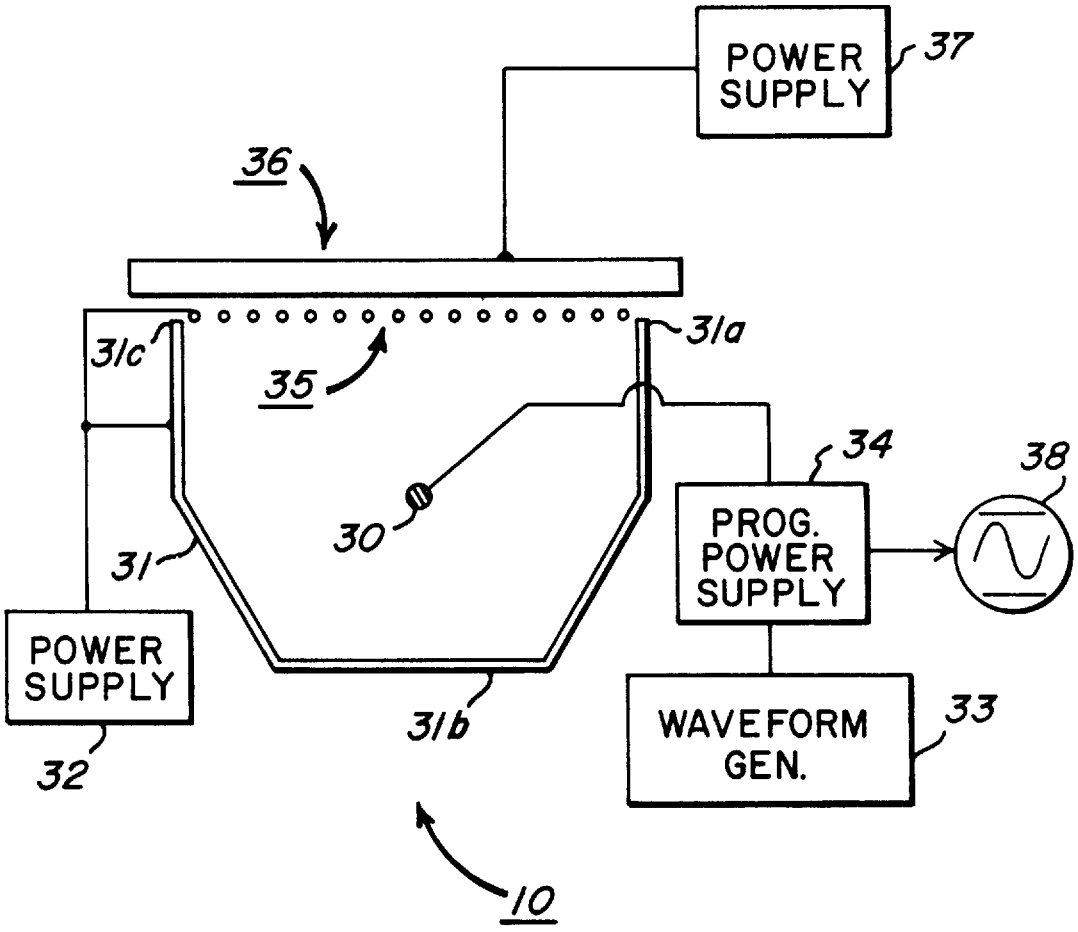
FIG. 2 is a schematic of a gridded corona charger or scorotron in accordance with a preferred embodiment of the invention.
Figure 3A:
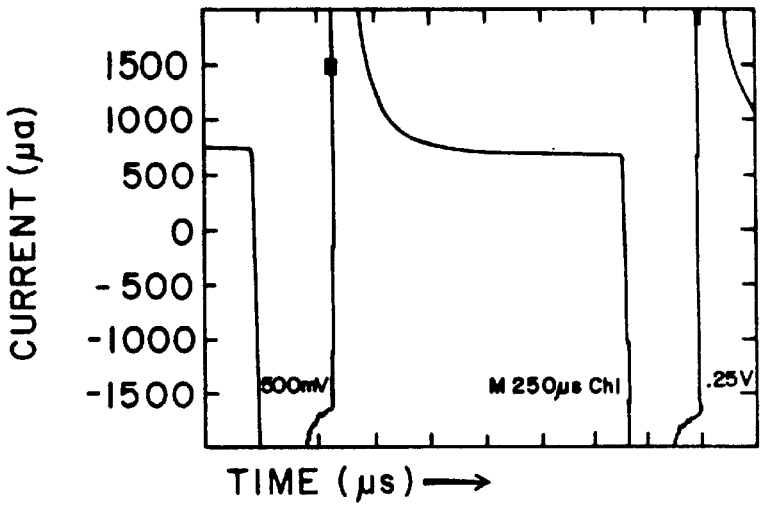
FIGS. 3*a*–3*e* are illustrations of oscilloscope traces of emission current in accordance with various duty cycles of voltage to a corona wire in the scorotron of FIG. 2.
Figure 3B:
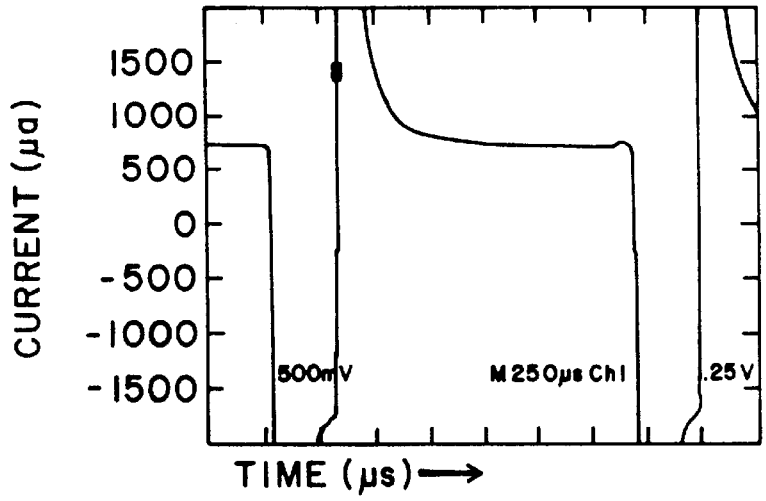
Figure 3C:
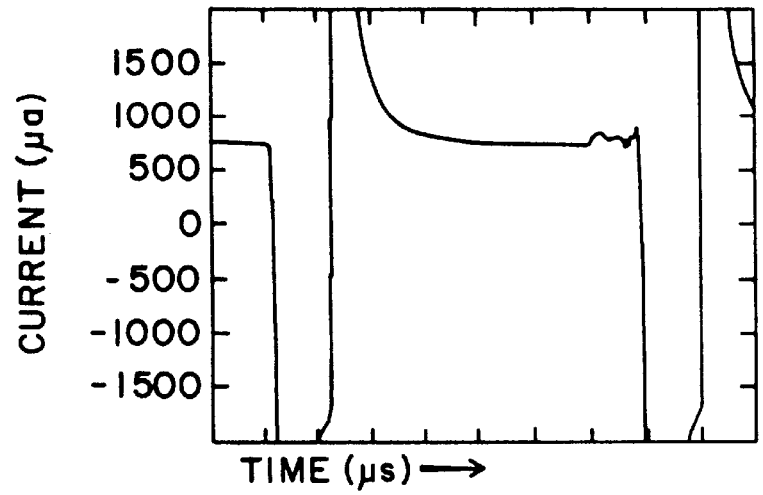
Figure 3D:
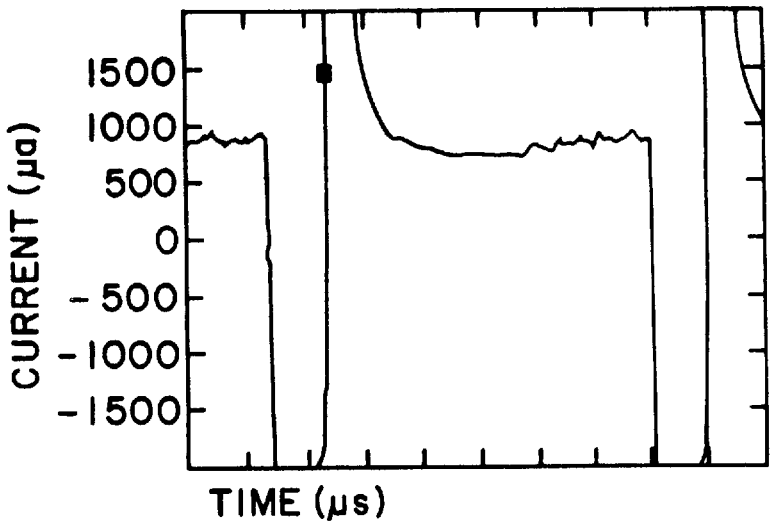
Figure 3E:
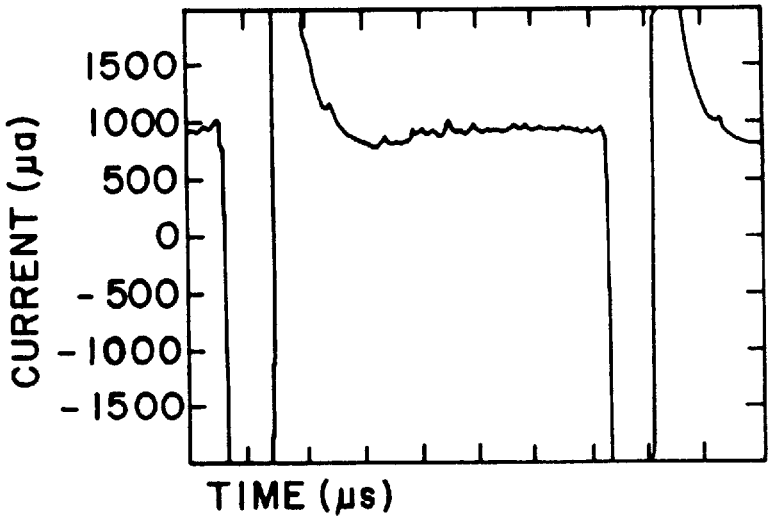

In example 1 we employed a used single-wire as-manufactured gridded primary charger removed from a commercial KODAK 1575 Copier Duplicator. This charger had been operated in positive DC mode for 145,000 copies. The surface of the corona wire was heavily contaminated by silica dendrites. There were also a few toner particles and other dust particles on the wire. An end-view sketch of the charger is shown as 10 in FIG. 2. The platinum alloy corona wire 30 had diameter of 90 μm (composition 79% platinum, 15% rhodium, 6% ruthenium). Grid 35 and shell 31 were electrically connected and biased to a DC voltage by Trek Corotrol Model 610C power supply 32, which also measured the sum of the grid and shell currents. The voltage to the corona wire was provided by the signal from a low voltage waveform generator 33 (Hewlett-Packard Model 3314A) amplified by a Trek Model 10/10 programmable power supply 34. The low voltage signal from the waveform generator 33 consisted of a variable duty cycle square wave AC signal, having peak voltage Vp, combined with a controllable DC offset voltage, Voff. The frequency was 600 Hz, but the invention is not limited to this frequency, and may be applied for a wide range of frequencies (including DC). This example illustrates the onset of sheeting as monitored by oscilloscope 38 using Vp=7.5 KV, Vgrid=Vshell=+600 V, and Voff=0. Owing to the finite slew rate of the Trek 10/10 amplifier 34, a trapezoidal wave form was produced at the corona wires. At 50% duty cycle, approximately 89% of the voltage of each positive or negative excursion was at peak. The voltage ramp was approximately the same width and shape at all duty cycles (up to 95% duty cycle). A transparent conductive NESA glass plate electrode 36 (hereafter, plate) was mounted parallel to and spaced 1.5 mm from grid 35. Plate 36 was held at ground potential by Trek Corotrol Model 610C power supply 37, which also monitored the plate current. Visible observation of strong sheeting was done by looking through the NESA glass plate electrode 36 with the charger operated in a darkened environmental chamber in which the RH was maintained at 10% and the temperature at 80° F. These conditions, especially the low RH, favor the observation and study of sheeting. The emission current waveform was monitored, at the current test point of the Trek Model 10/10 programmable power supply 34, by a Tektronix Model TDS 320 oscilloscope 38. The Trek 10/10 supply 34 was operated in the constant voltage mode in order to establish voltage regimes delineating sheeting. It has been discovered that sheeting pulses occur when a threshold peak voltage of the AC waveform is exceeded, said threshold peak voltage being dependent on the duty cycle of the waveform. Above threshold, if the peak voltage of the AC component is increased slightly or if the positive duty cycle is increased slightly, an excess emission current associated with the sheeting pulses is observed. At this point, the sheeting may not be detectable by eye, or perhaps a very weak light emission accompanies the sheeting pulses. A further small increase of either the peak voltage or the duty cycle usually produces a much brighter sustained glow discharge to nearby electrodes, e.g., shell or grid. The glow may be localized, e.g., near one end of a wire, with streamer-like discharges appearing to connect wire and shield, or wire and grid (if present). In severe cases, the glow may emanate radially along the entire wire length. When a sustained glow is seen, there is an accompanying significant increase of emission current. Moreover, if the voltage signal is maintained constant in the sustained glow condition, the emission current tends to increase with time. Still further increases (usually small increases) of peak voltage or duty cycle lead to arcing, i.e., breakdown, with an associated very large increase of emission current.

In FIG. 3 are given experimental results obtained with an aged bare tungsten wire charger, in which visible sheeting was relatively minor and confined to a short zone approximately one inch in length near one end of the fifteen inch long corona wire. FIG. 3*a* shows an oscilloscope trace of current versus time, measured at the current test point of the Trek 10/10 power supply 34. The positive duty cycle is 80%. Time is measured from left to right (250 μs per large division). The unit of current is 500 μa per large division, and the horizontal center line is zero current. At the start of each positive excursion, there is a displacement current spike which decays to an approximately constant positive current of about 720 μa. Similarly, at the start of each negative excursion, there is a displacement current spike which decays to about −1700 μa before the polarity reverses. No discernible sheeting was observed for the conditions of FIG. 3*a*. Onset of sheeting is first evident in FIG. 3*b* for which the duty cycle was increased to 82%. Although nothing as yet was observed by eye, the oscilloscope trace shows a slight disturbance just before the polarity reverses from positive to negative. At 83% duty cycle, the beginning of visible sheeting was noticed for a cluster of sites along about an inch or so of the corona wire, near one end. With further increases of the duty cycle, more sheeting sites developed on the wire, and more and more disturbance of the trace was observed, as shown in FIGS. 3*c*–3*e*, and summarized in Table 1. Note that this disturbance occurs earlier in time as duty cycle is raised, and that the integrated positive current also increases steadily. It is clear from Table 1, column 2, that the plate current (charging current) increases superlinearly as duty cycle is raised, rather than linearly which would be expected from increase of duty cycle alone. The total of the time-averaged grid current plus time-averaged shield current also increases superlinearly (third column), rather than linearly as would be similarly expected. Both of these superlinearities may be associated with excess current flowing in sheeting pulses. At 88% duty cycle the entire waveform is disturbed (FIG. 3*e*), there is a sustained visible discharge, and arcing is imminent.

TABLE 1

Onset of Sheeting

| Duty Cycle (%) | Plate Current (μa) | Grid Plus Shield Currents (μa) | Figure | Comment |
|---|---|---|---|---|
| 80 | 82 | 189 | 2a | No sheeting |
| 82 | 84 | 233 | 2b | First very faint sheeting at 83% |
| 84 | 86 | 288 | 2c | Quite noticeable sheeting |
| 86 | 90 | 363 | 2d | Strong sheeting |
| 88 | 94 | 448 | 2e | Arcing imminent |

This Example demonstrates that monitoring the total corona emission current waveform is an accurate way to measure the onset and degree of sheeting. It is a prototype example, in the sense that other pre-breakdown instabilities associated with a charger, e.g., in high voltage connectors, could also show up in the waveform and be monitored and controlled according to the invention.

EXAMPLE 2

Electronic Method of Sheeting Detection Using Sample and Hold Circuit, High Pass Filter, and RMS Voltmeter This example describes a circuit design, the input of which is a signal proportional to the current supplied to the corona wire, and the output of which is used for feedback by a process control circuit to limit the amplitude or duration of pre-breakdown electrical noise transients, or is used to trigger an error code or service call.

Figure 4:
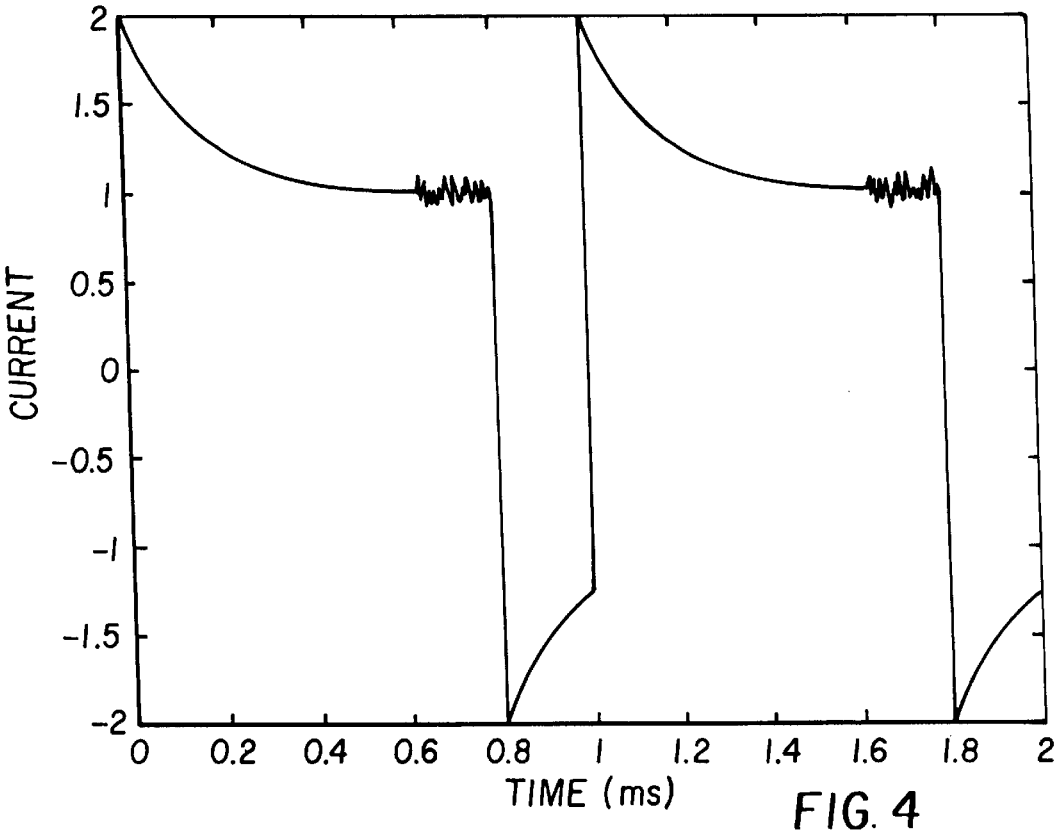
FIGS. 4, 5, 7–10, 12, 13, 15 and 16 are graphs that are descriptive of operation of the corona chargers of the invention.
Figure 5:
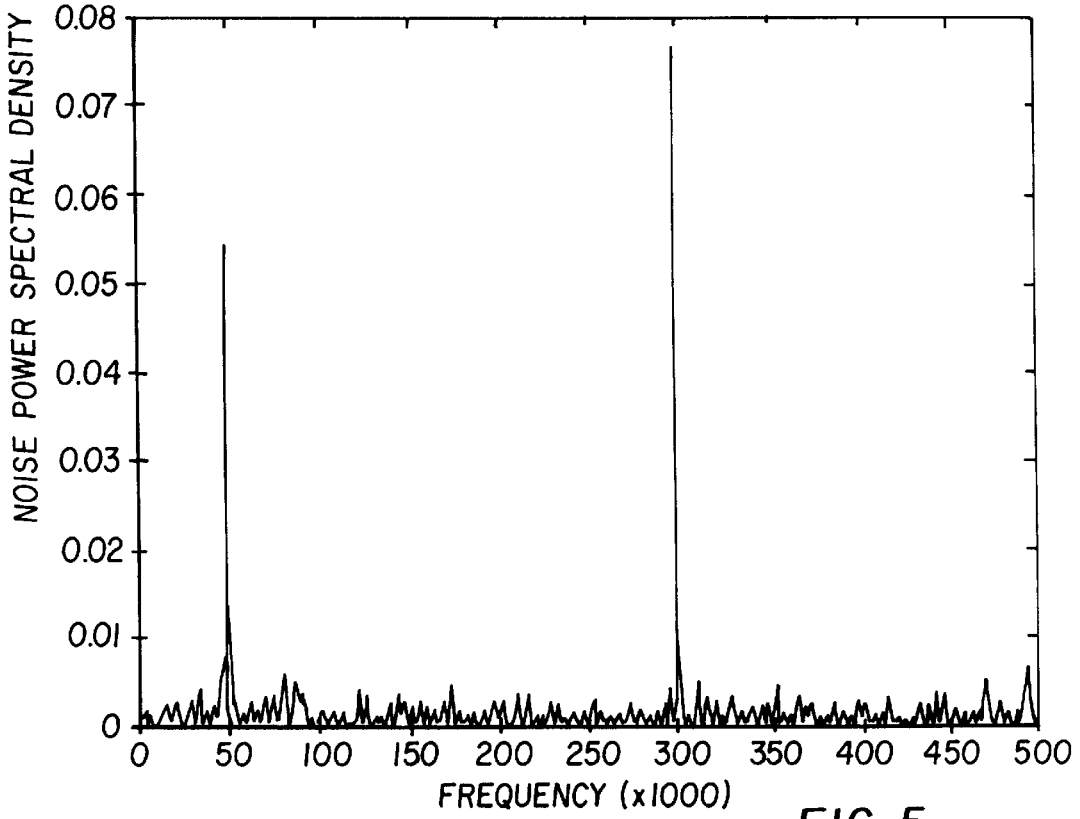

Experimental AC waveforms such as shown in FIGS. 3*a*–3*e* (and simulated in FIG. 4) are typical input waveforms, for which the amplitude and temporal duration of the noise associated with pre-breakdown currents can be detected or monitored according to the invention. The noisy portion of each cycle is hereafter referred to as the pre-arc noise signal or PANS. Pre-arc noise is distinguished from arcing noise in that arcing, and the noise generated from same, is a breakdown exhibiting an avalanching phenomenon that causes damage to equipment such as the charger's shell, grid or wire or to the photoconductor. Pre-arc noise is associated with an incipient breakdown and not exhibiting the avalanching phenomenon. Shown in FIG. 4 are two cycles of a computer-generated waveform having characteristics similar to a high duty cycle AC corona charger signal (see FIGS. 3*a*–*e*). The schematic signal shows a computed current waveform for an 80% positive duty cycle produced by a 1 KHz square wave excitation. After each change of polarity, a simulated displacement current spike relaxes exponentially with a suitable time constant. This artificial waveform exhibits a noise-like characteristic of pre-arc behavior (associated with print defects caused by sheeting, as seen in FIGS. 3*a*–*e*). In FIG. 4, the PANS is computer-generated using the noise power spectrum of FIG. 5. This noise power spectrum gives a reasonable simulation of the experimental PANS of FIG. 3*a*–*e*. It has large amplitudes at 50 Khz and 300 KHz superposed on normally distributed random noise.

Figure 6A:
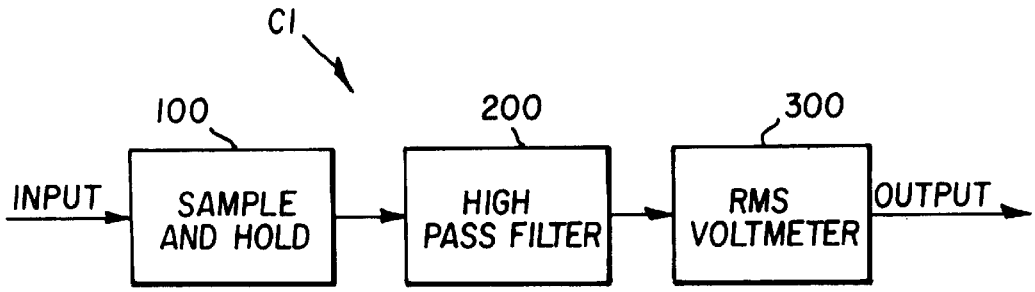
FIGS. 6*a*, 6*b*, 11, 14 and 17–18 are alternative embodiments of circuits for use in the apparatus of FIG. 1 for detecting the onset of sheeting.
Figure 7:
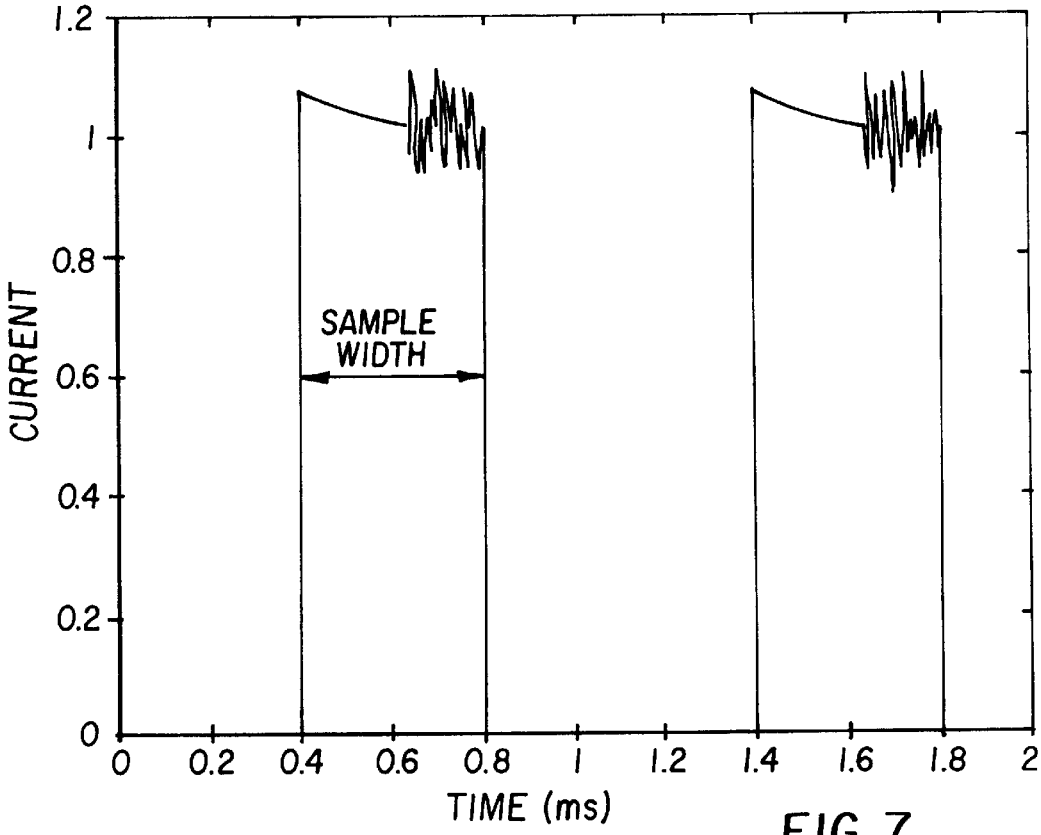
Figure 9:
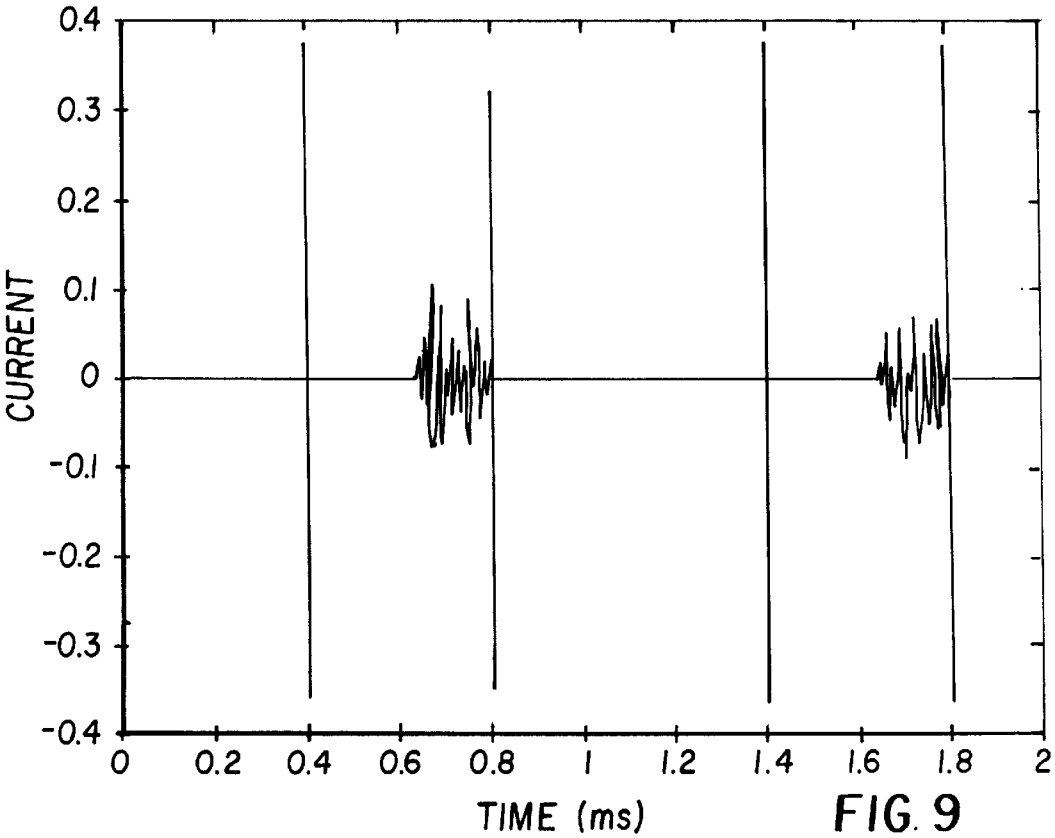
Figure 10:
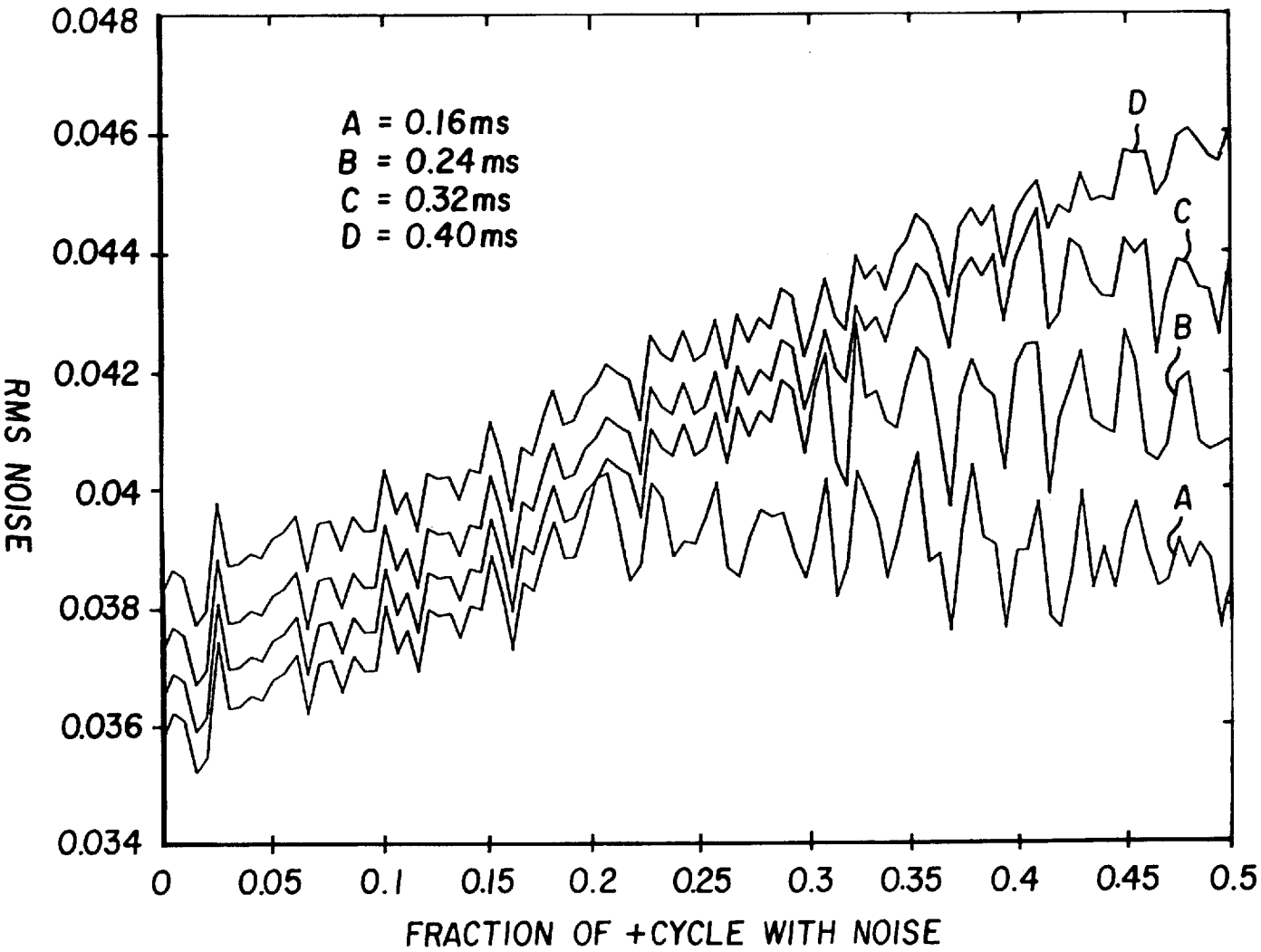

The schematic shown in FIG. 6*a* illustrates a circuit C1 forming one embodiment of the invention for detecting the PANS. The charger current is first sampled then filtered and finally converted to a root-mean-square (RMS) voltage that increases as the PANS gets larger either temporally or in amplitude (for a fixed duty cycle in a charger, both types of increase in the PANS are expected to occur as a corona wire ages in a copier). For this example, the sample and hold circuit 100 is set up so that the portion of the positive cycle that contains the PANS is sampled. (It is understood that any portion of an input waveform containing PANS may in general be sampled, depending on the practical application). FIG. 7 shows a typical output from the sample and hold circuit. Note that an end section of the positive portion of each cycle has been sampled. The sampled signal is sent to the high pass filter 200. The frequency response of the filter chosen for this example is graphed in FIG. 8 and the output of the filter is shown in FIG. 9. FIG. 10 shows the output of the RMS voltmeter or calculator 300 for detecting RMS voltage. The horizontal axis is the fraction of the positive portion of the current signal containing the pre-arc noise signal. The four curves represent four different sample widths used in the sample and hold circuit corresponding to 50%, 40%, 30%, and 20% of the positive portion of the cycle (0.40, 0.32, 0.24, and 0.16 ms, respectively). For each value on the horizontal axis, a new PANS signal was created (including a recomputation of the random noise component of FIG. 5) and then the RMS value was computed for each of the four sample widths. The RMS value is seen to increase as the PANS is increased temporally (at constant noise amplitude) but levels off after the PANS covers the entire range of the sampled length. The output of this circuit is not very sensitive to the PANS signal used in this example. The signal to noise ratio of each curve is rather low, and the RMS output changes by only a few per cent over the entire possible sample width. Nonetheless, this circuit can have adequate sensitivity for some applications of the invention.

Figure 6B:
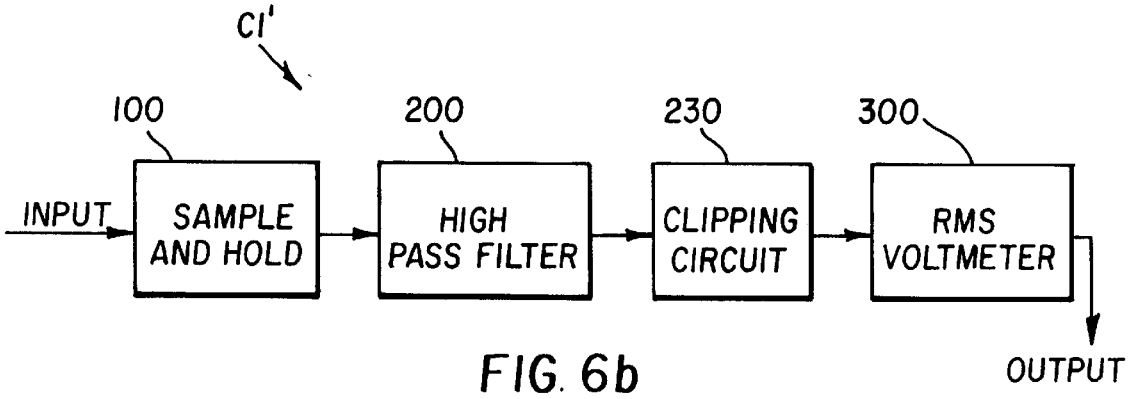
Figure 8:
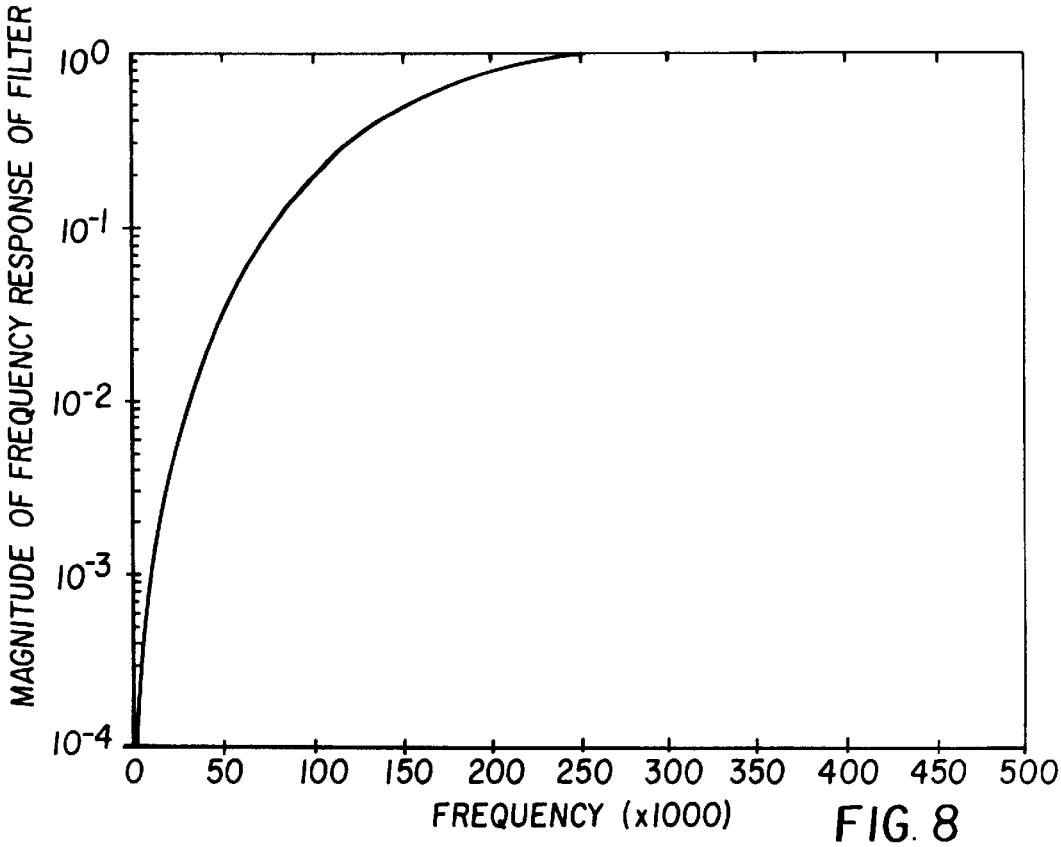

An improvement on this circuit is the circuit C1' shown in FIG. 6*b* wherein a clipping circuit 230 prior to the RMS voltmeter, so as to trim the large spikes in FIG. 8 that are associated with the sharp edges of the sampled portion of the input waveform. This will result in a much more sensitive response in the output.

Another improvement provided in C1' or in the other circuits described herein is averaging the RMS of the sampled and filtered signal over many cycles thereby reducing the noisiness of an RMS output (FIG. 9) wherein only one or a few cycles are averaged and improving sensitivity. The averaging of the RMS may be made by the RMS device or a separate circuit.

EXAMPLE 3

Figure 11:
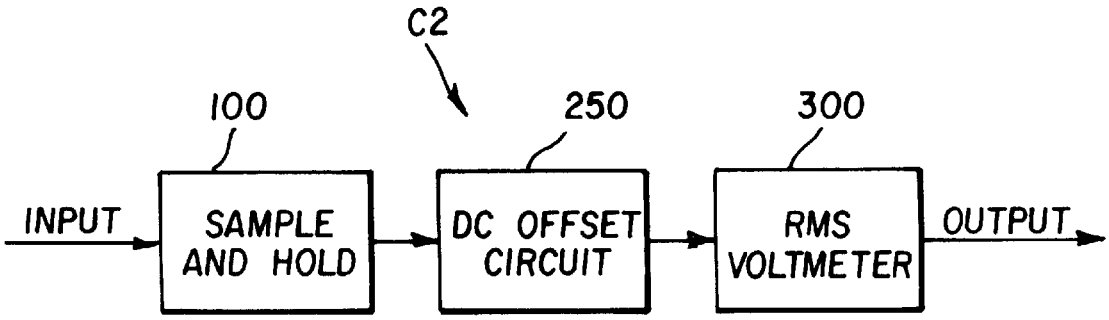
Figure 12:
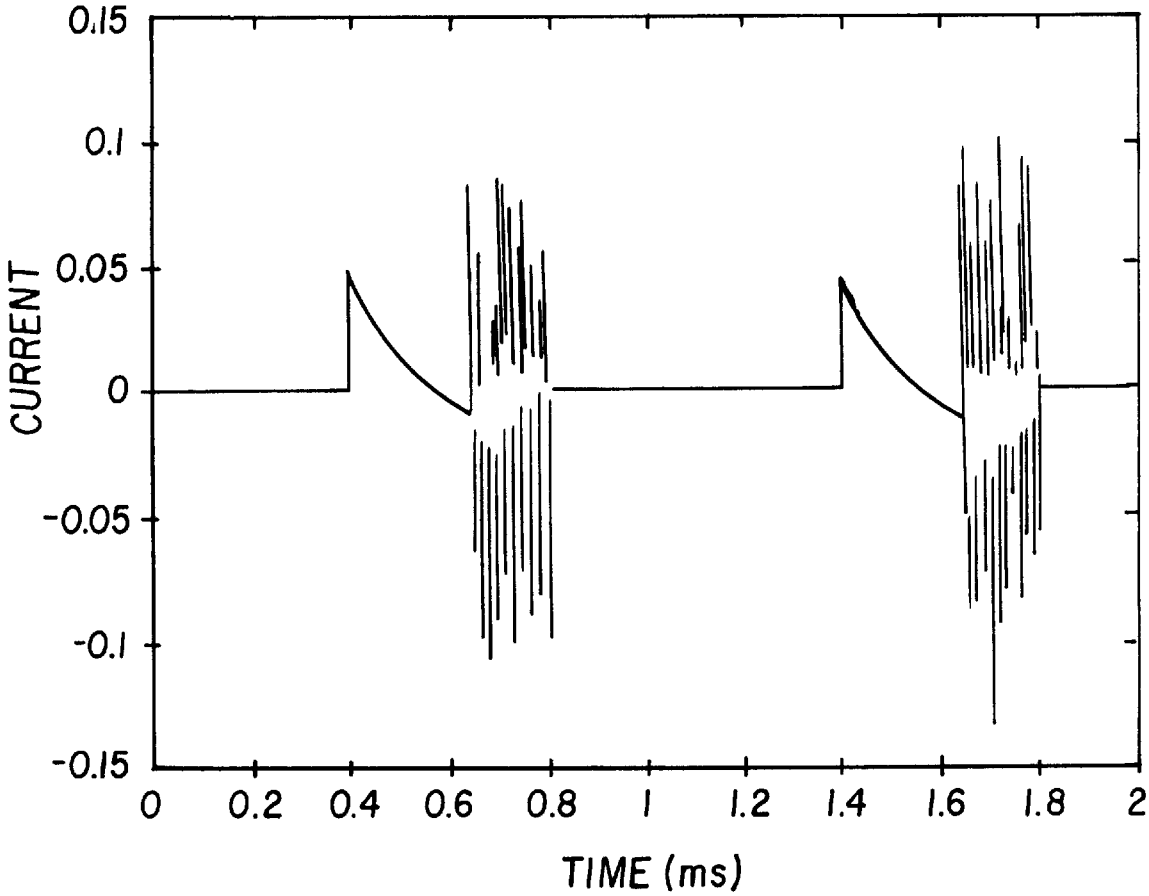
Figure 13:
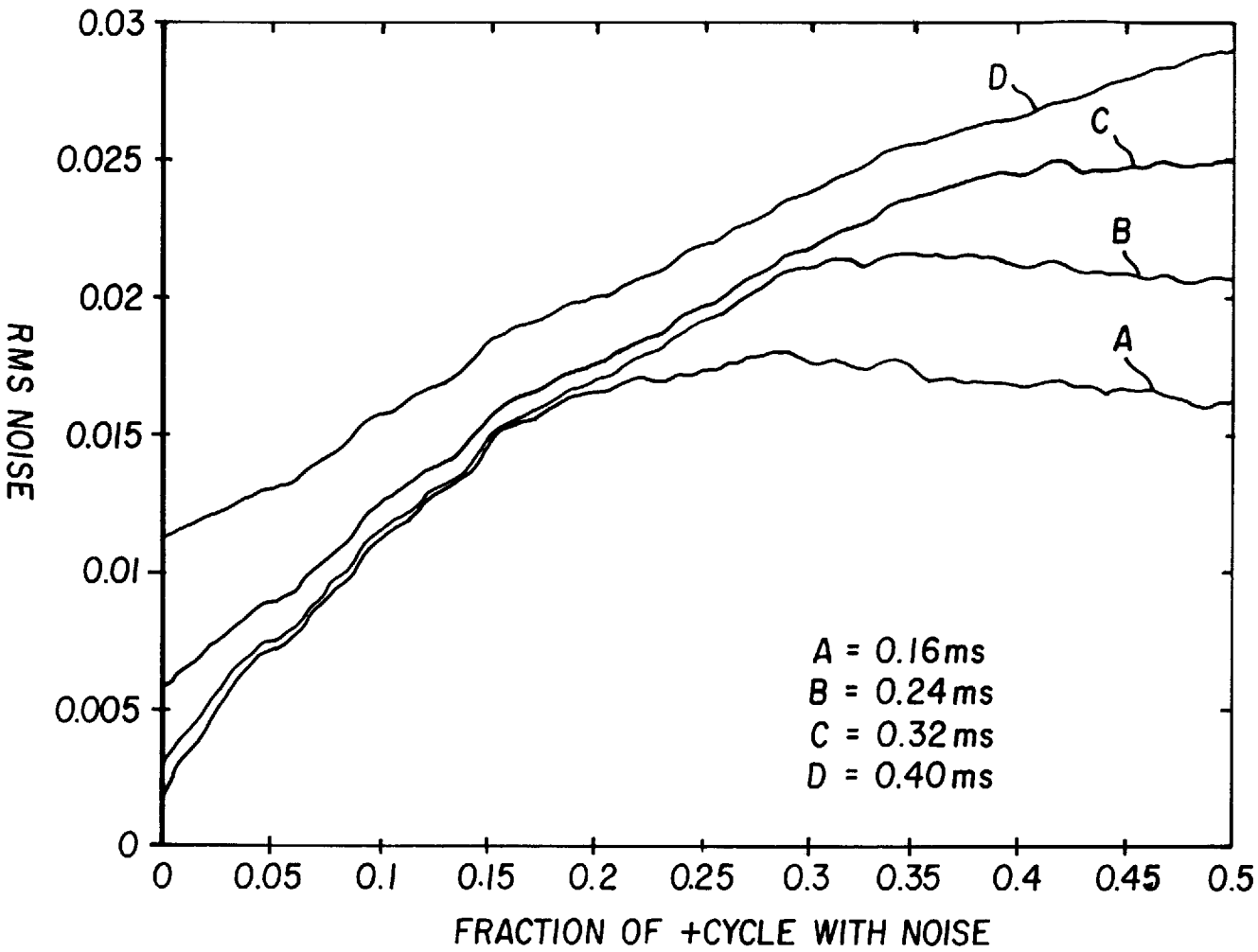

Electronic Method of Sheeting Detection Using Sample and Hold Circuit, DC Offset Circuit, and RMS Voltmeter This example teaches a third embodiment of the invention, shown in the schematic of FIG. 11, which is the same as that of FIG. 6 except that the filter 200 is replaced by a DC Offset circuit 250. The input waveform is generated in the same way as for example 2. The DC Offset circuit 250 subtracts from the sampled section of each cycle a constant value equal to the average value of each sampled portion of each cycle. The output of the DC Offset circuit is shown in FIG. 12. Alternatively, the DC offset circuit may subtract some predetermined value that is either a constant or otherwise determined. The output of the RMS voltmeter is shown in FIG. 13 for different sample widths. The large spikes seen in FIG. 9 are avoided by this mode of the invention. As a result, all the RMS values of FIG. 13 are much lower than those of FIG. 10. However, note that the RMS contribution from the PANS itself is larger then in FIG. 9 (because the mean value of the PANS portion of each cycle is now less than zero).

This circuit C2 is superior to the circuit C1' of FIG. 6*a* because it is more sensitive to the pre-arc signal and is most sensitive when the time constant of the corona wire current (input) signal is much less than its period.

EXAMPLE 4

Electronic Method of Sheeting Detection Using Sample and Hold Circuit, DC Offset Circuit, High Pass Filter and RMS Voltmeter This example describes the preferred mode of the invention.

Figure 14:
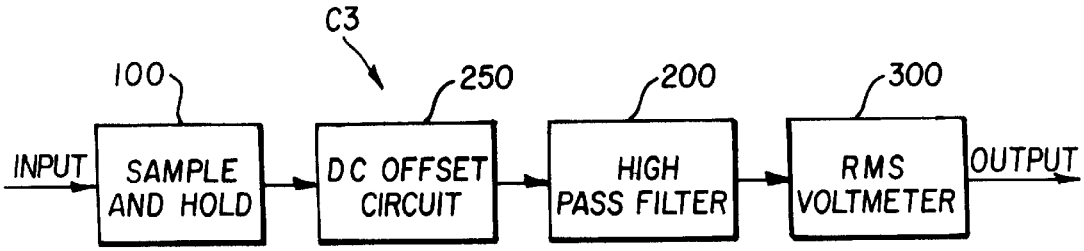
Figure 15:
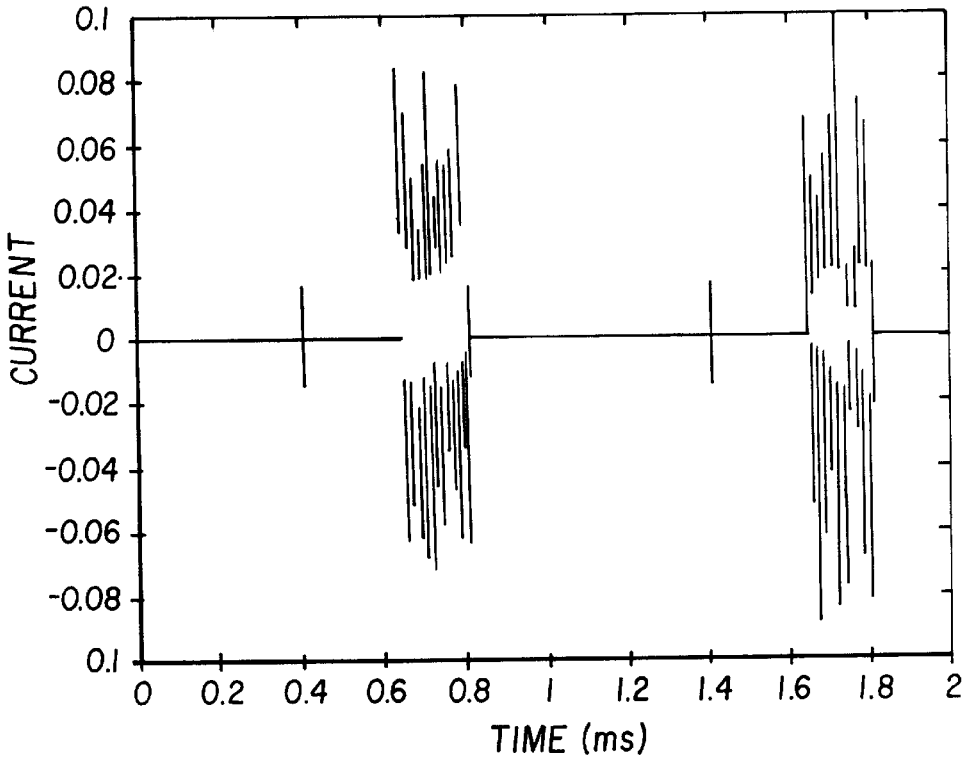
Figure 16:
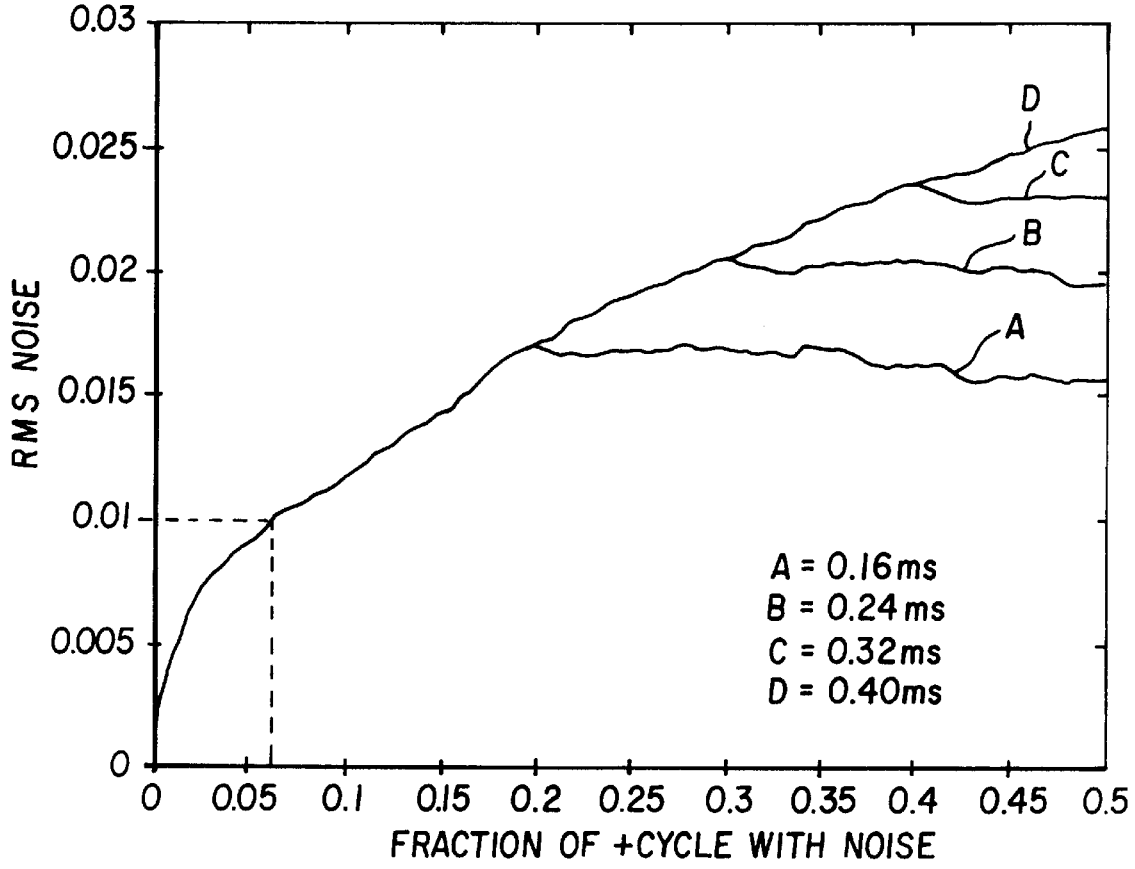

The circuit C3 shown in FIG. 14 is the same as that of FIG. 11 except that the filter of FIG. 6 is included between the DC Offset circuit 250 and the RMS voltmeter 300. The output of the filter is shown in FIG. 15. The output of the RMS voltmeter is shown in FIG. 16 for different sample widths. This circuit is more sensitive to the pre-arc signal then the circuit illustrated in FIG. 11, especially when the input signal's time constant is greater than about 0.1 times the period of the input signal.

In actual usage of the invention, a signal representing the RMS value can be input to the LCU and compared to a threshold value stored in the LCU. If the threshold is exceeded the LCU may issue an error code on the apparatus' operator control panel and/or a service call is automatically made to replace the charger. In the present case illustrated by FIG. 16, this threshold might for instance be set at an RMS value of 0.01, or some other suitable preselected value. Alternatively, when a preselected threshold value of the RMS output is reached, e.g., after a charger has aged after long usage in an electrophotographic machine, a feedback circuit can be activated. This feedback adjusts the operating parameters of the charger, such as the peak voltage on a corona wire, the offset voltage, the duty cycle, or the grid voltage on a scorotron, so as to keep the RMS output below the preselected threshold value. In this way, the effective life of a charger may be increased, and a service call delayed.

There has thus been illustrated an improved corona charger and method of charging that provides early detection of pre-breakdown currents, especially pre-breakdown currents associated with sheeting defects produced by electrophotographic chargers in positive charging. A service call or other communication can be provided in timely fashion, so as not to inconvenience a customer, and with reduced service cost. It has been shown that the RMS output of a pre-breakdown current detection circuit can provide a useful signal for feedback control to adjust operating set points of a high voltage apparatus. Although the invention is useful to AC and DC corona chargers feedback is particularly useful with an electrostatographic AC scorotron positive charger having a variable duty cycle squarewave excitation. For example, feedback control of AC peak wire voltage, grid voltage, DC offset, frequency, or duty cycle may be used in conjunction with a pre-specified threshold value of the RMS output.

Feedback makes it possible to extend the life of a corona charger. For example, charging current can be maintained as a charger ages in a copier, by adjusting the operating set points (such as duty cycle or peak voltage or grid voltage or the other noted parameters) to keep the RMS output signal (due to sheeting) below a pre-specified value. Although illustrated with reference to a primary corona charger, other charging devices also may be used such as detack chargers, transfer chargers or preclean chargers.

In lieu of specific circuits the invention may be carried out by a computer having signals input thereto and programmed to perform one or more of the individual circuit operations to the signals.

Figure 17:
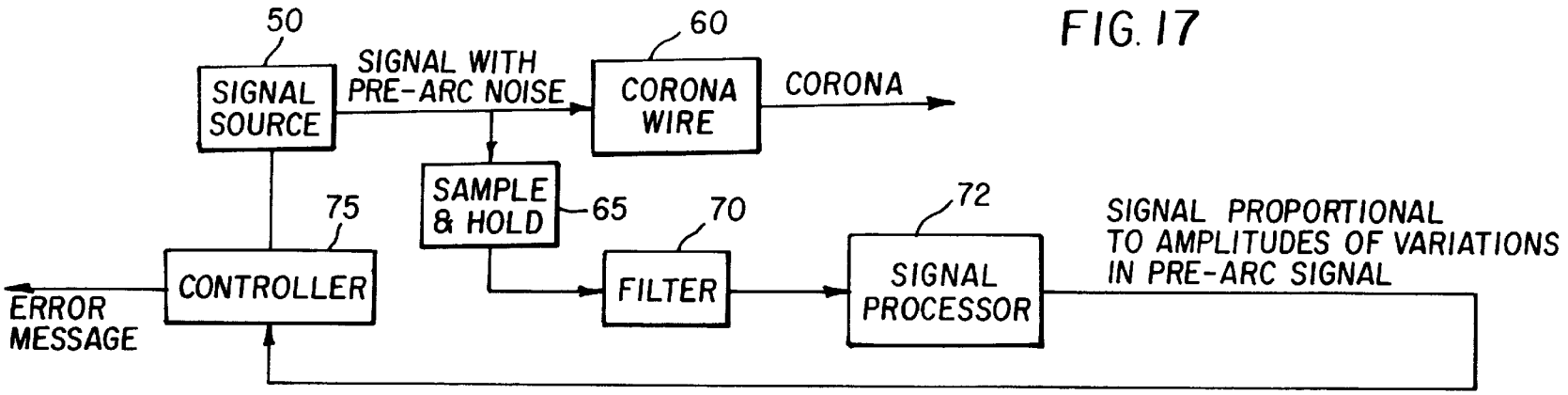

While specific techniques using RMS detection of the noise is disclosed, other techniques and circuits for noise detection may also be used including circuits for examining amplitude of the noise or frequency. The noise may be detected through direct electrical connection to the charging circuit or by detecting the field around such circuit. Regardless of the signal processing, be it digital or analog or a combination of both, the pre-arc noise condition is sensed and when determined to be present is either used to shut down the apparatus and/or to generate error messages and/or other communications or adjustment in an operating parameter is made to remove or minimize a condition tending to create sheeting or allow acceptable operation of the charger without the likelihood of an arcing condition being created. Generally, as shown in FIGS. 17 a signal source such as a power supply outputs a high voltage signal of at least 4 kilovolts to a corona wire or wires 60. A part of the signal to the corona wire(s) is sampled by a sample and hold circuit 65 which may be eliminated if the signal from the signal source is DC. A filter 70 passes the high frequency component of the noise to a signal processor 72 which analyzes the amplitude of the noise and outputs a signal proportional or related to amplitude of the noise in the pre-arc signal. This latter signal is used by a controller 75 to adjust the signal source to reduce the likelihood of generation of pre-arc noise as discussed above or to shut it down entirely. Additionally, an error message may be displayed or stored in memory for future reference.

Figure 18:
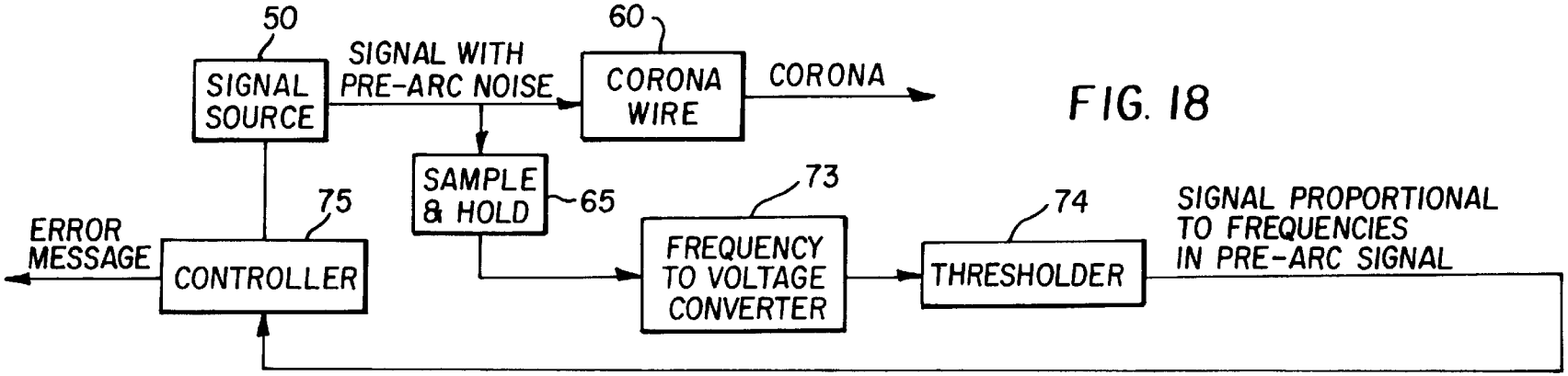

With reference to FIG. 18, a modification of the general circuit of FIG. 17 is provided that also may be useful. In FIG. 18, where the same or corresponding circuits are similarly designated, the circuit for detecting pre-arc noise uses a frequency to voltage converter 73 to detect the pre-arc noise and employs a thresholder or comparator 74 suitably adjusted to distinguish between transient noise and the more persistent noise associated with pre-arc noise. If this threshold is exceeded, a signal is sent to the controller 75 and acted upon as described above.

The invention has been described in detail with particular reference to certain preferred embodiments thereof, but it will be understood that variations and modifications can be effected within the spirit and scope of the invention.

What is claimed is:

1. A corona charger for applying an electrostatic charge to a charge retentive surface, the charger comprising:

a coronode;

a power supply applying a voltage to the coronode; and a detector for detecting pre-arc noise in operation of the coronode and issuing a signal in response to detection of the pre-arc noise.

2. The charger of claim 1 wherein the detector includes a sample and hold circuit that is connected to the power supply to sample at least a portion of a current output by the power supply and output a sampled signal, a high pass filter for filtering the sampled signal and generating a filtered signal and a circuit for generating a root-mean-square (RMS) value of the filtered signal.

3. The charger of claim 2 and wherein a clipping circuit is provided to reduce amplitudes of portions of the filtered signal.

4. The charger of claim 3 and wherein an averaging is provided of the RMS values of the filtered signal.

5. The charger of claim 1 wherein the detector includes a sample and hold circuit that is connected to the power supply to sample at least a portion of a current output by the power supply and output a sampled signal, a DC offset circuit that provides at its output a signal representing the sampled signal less a DC offset value and a root-mean-square (RMS) generating circuit responsive to an output of the DC offset circuit and generating RMS values related to the output of the DC offset circuit.

6. The charger of claim 5 wherein the detector includes a high pass filter that is responsive to the signal at the output of the DC offset circuit and provides a high pass filtering of this signal.

7. A method for applying an electrostatic charge to a charge retentive surface, the method comprising:

operating a corona charger including a coronode to apply corona charge to the charge retentive surface;

sensing a condition of pre-arc noise in operation of the coronode; and generating a signal in response to sensing of the condition of pre-arc noise.

8. The method of claim 7 and wherein the signal provides a message representing malfunction of the charger.

9. The method of claim 7 wherein a current to the coronode is sampled to generate a sampled signal, a signal related to the sampled signal is filtered to generate a filtered signal, and a root-mean-square (RMS) value of the filtered signal is generated for use in sensing pre-arc noise.

10. The method of claim 9 and wherein amplitudes of portions of the filtered signal are reduced by a clipping operation.

11. The method of claim 10 and wherein RMS values of the filtered signal are averaged for use in sensing pre-arc noise.

12. The method of claim 7 wherein a current to the coronode is sampled to provide a sampled current, a first signal representing a DC offset of the sampled current is generated, and a signal representing root-mean-square (RMS) values of the first signal is generated for use in sensing pre-arc noise.

13. The method of claim 12 and including the step of high pass filtering of the first signal prior to determining of the RMS values of the first signal.

14. An electrical control device for use with a corona charging device and an electrical circuit for driving the charging device, the control device comprising:

a first circuit for sensing a condition of pre-arc noise in the electrical circuit for driving the charging device; and a second circuit responsive to sensing a condition of pre-arc noise for generating a signal indicating presence of said condition.

15. The device of claim 14 and including a third circuit that is responsive to the signal to generate a message indicating said condition or malfunction of the electrical circuit.

16. The device of claim 14 and including a third circuit that is responsive to the signal to generate a second signal to adjust operation of the electrical circuit.

17. A method for determining proper operation of an electrical circuit for driving a corona charging device, comprising:

sensing a condition of pre-arc noise in the electrical circuit; and in response to sensing a condition of pre-arc noise generating a signal indicating presence of said condition.

18. The method of claim 17 wherein the signal is used to generate a message indicating said condition or malfunction of the electrical circuit.

19. The method of claim 17 wherein in response to the signal a second signal is generated to adjust operation of the electrical circuit.

* * * * *